United States Patent [19]

Marchesano

[11] Patent Number: 4,501,812

[45] Date of Patent: Feb. 26, 1985

[54] PHOTOGRAPHIC COLOR DEVELOPER COMPOSITION PACKAGED IN TWO OR MORE CONCENTRATED PARTS, PARTICULARLY SOLUTIONS, AND CONCENTRATED COLOR DEVELOPER WATER SOLUTION

[75] Inventor: Carlo Marchesano, Savona, Italy

[73] Assignee: Minnesota Mining and Manufacturing Company, St. Paul, Minn.

[21] Appl. No.: 576,349

[22] Filed: Feb. 2, 1984

[30] Foreign Application Priority Data

Feb. 10, 1983 [IT] Italy ..... 65203 A/83

[51] Int. Cl.[3] ..... G03C 5/30; G03C 7/30; G03C 5/24

[52] U.S. Cl. ..... 430/466; 430/450; 430/467; 430/484

[58] Field of Search ..... 430/484, 466, 450, 467

[56] References Cited

U.S. PATENT DOCUMENTS

| | | | |
|---|---|---|---|
| 3,574,619 | 4/1971 | Surash | 430/466 |
| 3,615,572 | 10/1971 | Bimmler et al. | 96/55 |
| 3,721,563 | 3/1973 | Fisch et al. | 430/450 |
| 3,814,606 | 6/1974 | Ozawa et al. | 430/466 |

*Primary Examiner*—Mary F. Downey

*Attorney, Agent, or Firm*—Donald M. Sell; James A. Smith; Mark A. Litman

[57] ABSTRACT

Color developer composition packaged in two or more concentrated parts, which on mixing with water give a ready-for-use silver halide developer solution, one part thereof comprising an aqueous concentrated solution containing a N-hydroxyalkylsubstituted p-phenylene diamine salt developing agent and a sulfite compound, said aqueous concentrated solution having a pH from 6 to 8. In particular, said N-hydroxyalkyl-substituted p-phenylene diamine developing agent is a 4-amino-3-methyl-N-ethyl-N-($\beta$-hydroxyethyl)-aniline and the molar ratio of the sulfite compound to the developing agent is higher than 1.5:1.

12 Claims, No Drawings

PHOTOGRAPHIC COLOR DEVELOPER COMPOSITION PACKAGED IN TWO OR MORE CONCENTRATED PARTS, PARTICULARLY SOLUTIONS, AND CONCENTRATED COLOR DEVELOPER WATER SOLUTION

FIELD OF THE INVENTION

The present invention relates to concentrated color developer compositions. More particularly, the present invention relates to photographic color developer compositions packaged in two or more concentrated parts that on mixing with water provide color developers ready for use.

BACKGROUND OF THE ART

Generally, a developer solution, for use in color photography, consists of a water solution of various components including p-phenylene diamine developing agent which is oxidized by the exposed silver halide to react with a coupler and form a dye.

Such components include an antioxidant(s), an alkalizing agent(s), a buffering agent(s), an optical brightener(s), a development modifier(s), as well as other known components, such as those described for example in Research Disclosure 17643, December 1978.

It is material to the user of the chemistry for color photographic processing that such water solutions of the p-phenylene diamine color developing agent and additional components be prepared from concentrated compositions easily mixed with water. Such concentrated compositions must also be stable in the various storage conditions. Since it is not possible to make a single concentrated composition of the developer solution as such (due to both solubility and stability problems), it has become normal practice in the art to divide and package it into various groups of components to be mixed in water and prepare the bath for use.

The stability problems are particularly critical with p-phenylene diamine color developing agents, which have the tendency to oxidize in storage. To prevent this aerial oxidation, sulfite compounds required for the ready-for-use developer have been added to the concentrate containing the developing agents. However, the addition of sulfite compounds results in a degradation of the developing agent. In U.S. Pat. No. 3,615,572, reissued on Oct. 1, 1974 as U.S. Pat. No. Re. 28,185, a method for reducing the degradation of the developing agent has beed described, which comprises keeping the concentrated aqueous solution at pH less than about 4, preferably less than 1, the molar ratio of the sulfite compound to color developing agent being between 0.08:1 and 1.5:1, preferably between 0.08:1 and 0.5:1. This method, while protecting p-phenylene diamine compounds against degradation, reduces the effectiveness of the protection against aerial oxidation (sulfite at low pH is rapidly decomposed giving rise to evolution of sulfur dioxide). In practice, further quantities of sulfite compounds are to be incorporated into another part of the composition, but this does not prevent oxidation during storage of the concentrated developer solution.

SUMMARY OF THE INVENTION

We have now found according to the present invention that aqueous color developer solutions can be prepared by using a N-hydroxyalkyl-substituted p-phenylene diamine salt developing agent and a sulfite compound in sufficient amount to prevent aerial oxidation without degradation of the developing agent upon storage if the pH of the aqueous concentrate is maintained from 6 to 8. Preferably, the molar ratio of the sulfite compound to the N-hydroxyalkyl-substituted p-phenylene diamine salt developing agent is higher than 1.5:1. The N-hydroxyalkyl-substituted p-phenylene diamine developing agent is preferably a 4-amino-3-methyl-N-ethyl-N-(β-hydroxyethyl)-aniline salt.

DETAILED DESCRIPTION OF THE INVENTION

Accordingly, the present invention relates to a color developer composition packaged in two or more concentrated parts (particularly solutions), that on mixing with water form a ready-for-use silver halide color developer solution, one part thereof consisting of an aqueous concentrated solution containing an N-hydroxyalkyl-substituted p-phenylene diamine salt developing agent and a sulfite compound, said aqueous concentrated solution having a pH from 6 to 8.

Preferably, the present invention relates to a color developer composition as described above in which said concentrated aqueous solution contains 4-amino-3-methyl-N-ethyl-N-(β-hydroxyethyl)-aniline salt as developing agent.

In particular, the present invention relates to a color developer composition as described above in which the molar ratio of the sulfite compound to the developing agent within said concentrated aqueous solution is higher than 1.5:1, more preferably higher than 2:1.

Still particularly, the present invention relates to a color developer composition as described above in which said aqueous concentrated solution additionally contains ascorbic acid.

More particularly, the present invention relates to a color developer composition as described above in which said aqueous concentrated solution contains 50 to 120 grams per liter of the N-hydroxyalkyl-substituted p-phenylene diamine salt developing agent.

Still more particularly, the present invention relates to a color developer composition as described above, comprising a second concentrated part including an alkaline substance and a third concentrated part including a hydroxylamine compound.

According to another aspect, the present invention relates to an aqueous concentrated solution comprising an N-hydroxyalkyl-substituted p-phenylene diamine salt developing agent and a sulfite compound, said aqueous concentrated solution having a pH from 6 to 8.

Preferably, the present invention relates to an aqueous concentrated solution as described above in which the N-hydroxyalkyl-substituted p-phenylene diamine salt developing agent is a 4-amino-3-methyl-N-ethyl-N-(β-hydroxyethyl)-aniline salt.

Particularly, the present invention relates to an aqueous concentrated solution as described above in which the molar ratio of the sulfite compound to the developing agent being higher than 1.5:1, more preferably higher than 2:1.

Still particularly, the present invention relates to an aqueous concentrated solution as described above in which said aqueous concentrated solution additionally includes ascorbic acid.

More particularly, the present invention relates to an aqueous concentrated solution as described above containing 50 to 120 grams per liter of the N-hydroxyalkyl-substituted p-phenylene diamine salt developing agent.

The developing agents useful in the present invention are quaternary nitrogen salts of N-hydroxyalkyl-substituted p-phenylene diamine compounds, particularly those which can be represented by the following general formula:

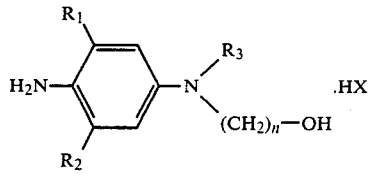

wherein:

$R_1$ represents hydrogen or an alkyl group with 1 to 4 carbon atoms, or an alkoxy group with 1 to 4 carbon atoms; $R_2$ represents hydrogen or an alkyl group with 1 to 4 carbon atoms; $R_3$ represents an alkyl group with 1 to 4 carbon atoms; n represents 1 or 2; and HX represents hydrochloric, sulforic, nitric and phosphoric acid.

Such p-phenylene diamine color developing agents are unstable in their free base form and are generally used as salts (the most common being those specified in the above formula). Typical examples include 4-amino-3-methyl-N-ethyl-N-(β-hydroxyethyl)-aniline salts and 4-amino-N-ethyl-N-(β-hydroxyethyl)-aniline salts.

Preferably, in the present invention the 4-amino-3-methyl-N-ethyl-(β-hydroxyethyl)-aniline sulfate monohydrate, which is marketed under the designation CD-4 and is used in a majority of color photographic processes (for example for developing color negative films, such as Kodak C41 Process and 3M CNP-4 Process), proved to be particularly useful.

The aqueous concentrated solution includes as an antioxidant a sulfite compound. "Sulfite compound" means a compound which is capable of generating sulfite ions in water solution, such as alkali metal sulfites, bisulfites and metabisulfites, the preferred compounds being sodium sulfite and potassium metabisulfite.

The quantity of sulfite compound(s) with respect to the p-phenylene diamine developer compound present in the aqueous concentrated solution preferably exceeds the molar ratio of 1.5:1 and, more preferably, of 2:1. Such quantities of sulfite compound(s) ensure that the p-phenylene diamine color developing agent does not appreciably decompose during storage. Upper limits can be determined by quantities which significantly diminish the activity of the developer ready for use (when, for example, the molar ratio of sulfite compound(s) to the developer is higher than 3:1).

Other antioxidants, such as ascorbic acid, stereoisomers and diasteroisomers of ascorbic acid and their sugar-type derivatives, can be used in addition to or in partial replacement of the sulfite compound(s) in order to extend and improve the stability of the aqueous concentrated solution. Useful molar proportions of ascorbic acid with respect to the developing agent preferably range from 0.01:1 to 0.1:1, more preferably from 0.02:1 to 0.05:1 (higher quantities of ascorbic acid giving rise to sensitometric drawbacks, such as cyan fog tendency). In the presence of ascorbic acid, the sulfite compound(s) is preferably used in a molar ratio of 1 to 1.5 of sulfite to 1 of developer (the remaining sulfite possibly necessary to stabilize the ready-for-use developing composition being incorporated in the concentrated alkaline part). The pH of the sulfite compound(s) containing aqueous concentrated solution was critical with respect to its stability. On one side, at pH lower than 6 the sulfite compound(s) showed a tendency to decompose with sulfur dioxide evolution and the developing agent showed a tendency to degrade. On the other side, at a pH higher than 8, the developing agent showed a tendency to oxidize with formation of oil tars after high temperature storage. Accordingly, the pH of the aqueous concentrated solution needed to be adjusted (with alkali, for example potassium hydroxide) at values between 6 and 8, preferably between 6.2 and 7.0.

The concentration of the developing agent in the aqueous concentrated solution is generally between 50 and 120 grams of the developing agent per liter to give a ready-for-use developer solution containing, for example, 3 to 10 grams per liter or, more particularly, 4 to 6 grams per liter of developing agent.

Other conventional components used in developer solutions can be included in the aqueous concentrated solutions of this invention. They include antifoggants, such as benzotriazole, development restrainers, such as alkali metal bromides and iodides, and anticalcium agents, such as aminopolycarboxylic acids (for example nitrilotriacetic acid (i.e., NTA), diaminopropanoltetracetic acid (i.e., DPTA) and diethylenetriaminopentacetic acid (i.e., DTPA)), aminopolyphosphonic acid and nitrilotrimethylenephosphonic acid and hydroxyalkylidendiphosphonic acid. Preferably, the specific gravity (measured at 20° C.) of said aqueous concentrated solutions is between 1.030 and 1.120, more preferably between 1.060 and 1.100. It has been found that, at concentrations exceeding the higher values, the pH of the concentrated solutions must be more acidic to have a liquid and limpid solution, thus loosing the beneficial effects of this invention.

The alkaline substance which forms the second concentrated part of the present invention is generally sodium or potassium hydroxide or carbonate. This part can contain other components such as accelerators, complexing agents, buffers, e.g. citric acid-citrate, boric acid-borate, sodium and potassium carbonate and anticalcium agents. Other additional ingredients can, if desired, be present in further separate concentrated parts of the color developer composition. For example, hydroxylamine salts, such as hydroxylamine sulfate and hydrochloride, when used, can neither be used in the aqueous concentrated solution containing the p-phenylene diamine developing agent, nor in the concentrated part containing the alkaline substance, both for stability and sensitometric problems. In this case, hydroxylamine compounds are included in a third aqueous concentrated part.

The solutions and compositions of the present invention are particularly useful in providing color developers for processing incorporate-coupler silver halide photographic materials, for example, multilayer color materials containing a support base having superposed red, green and blue light sensitive silver halide emulsion layers containing cyan-forming couplers (e.g. phenolic and naphtholic compounds), magenta-forming couplers (e.g. 5-pyrazolone compounds) and yellow-forming couplers (e.g. open-chain ketomethylene compounds), respectively.

The following examples are illustrative of the compositions and solutions of the present invention.

EXAMPLE 1

A concentrated solution was prepared by adding to 800 ml. of water at room temperature in the indicated order: 57 ml. of 35% KOH, 57 g. of $K_2S_2O_5$ (0.257 moles) and 75.5 g. of $CD_4.H_2SO_4.H_2O$ (0.244 moles) and stirring till a limpid solution was obtained. Water was added to a final volume of 1,000 ml. The resulting pH was 6.5. After storage for 1 month in an oven at 50° C., this solution did not exhibit substantial increase in color or turbidity, in comparison with a fresh solution. No evolution of sulfur dioxide was noticed either in the fresh or stored solution.

EXAMPLE 2

A concentrated solution was prepared by adding to 700 ml. of water at room temperature in the indicated order: 30 ml. of KOH, 20 g. of $K_2S_2O_5$, 4.3 g. of KCl, 1 g. of Vitamin C, 53 g. of $CD_4.H_2SO_4.H_2O$ and stirring till a limpid solution was obtained. Water was added up to a final volume of 800 ml. The resulting pH was 7.

The solution, stored for one month at 50° C. or for four months at room temperature, did not exhibit substantial increase in color or turbidity. No evolution of sulfur dioxide was noticed in either the fresh and stored solution.

EXAMPLE 3

Concentrated developer solutions A, B, C and D were prepared according to the following table:

TABLE 1

| | A | B | C | D |
|---|---|---|---|---|
| Water ml. | 700 | 850 | 450 | 490 |
| 35% KOH ml. | 30.0 | 70.0 | 40.0 | 26.0 |
| $K_2S_2O_5$ g. | 40.0 | 40.0 | 40.0 | 40.0 |
| KBr g. | 10.5 | 10.5 | — | — |
| KCl g. | 4.5 | 4.5 | — | — |
| DTPA g. | — | 25.0 | — | — |
| NTA.3Na.$H_2O$ g. | — | 5.0 | — | — |
| $CD_4.H_2SO_4.H_2O$ g. | 53.0 | 53.0 | 53.0 | 53.0 |
| Water to make ml. | 800 | 1,000 | 770 | 600 |
| Specific gravity at 20° C. | 1.085 | 1.097 | 1.078 | 1.089 |
| pH at 20 °C. | 6.85 | 7.00 | 6.50 | 5.55 |

Concentrated antioxidant solution E was prepared according to the following table:

TABLE 2

| | E |
|---|---|
| Water ml. | 40.0 |
| 33.3% $H_2SO_4$ ml. | 40.5 |
| $NH_2OH.\frac{1}{2}H_2SO_4$ ml. | 28.5 |
| Water to make ml. | 100 |
| Specific gravity at 20° C. | 1.255 |
| pH at 20° C. | 0 |

Concentrated pH adjusting solution F was prepared according to the following table:

TABLE 3

| | F |
|---|---|
| Water ml. | 400.0 |
| $K_2CO_3$ g. | 374.0 |
| Water to make ml. | 600.0 |
| Specific gravity at 20° C. | 1.460 |
| pH at 20° C. | 12.92 |

Concentrated starter solution G was prepared according to the following table:

TABLE 4

| | G |
|---|---|
| Water ml. | 600.0 |
| $K_2CO_3$ g. | 195.5 |
| $NaHCO_3$ g. | 37.5 |
| KCl g. | 4.8 |
| KJ mg. | 73.3 |
| NaBr g. | 37.6 |
| DTPA g. | 21.5 |
| NTA.3Na.$H_2O$ g. | 5.0 |
| 35% KOH g. | 13.0 |
| $H_2O$ to make ml. | 1,000 |
| Specific Gravity at 20° C. | 1.215 |
| pH at 20° C. | 10.07 |

Color developers ready for use H (using concentrated developer solution C), I (using concentrated developer solution B) and L (using concentrated developer solution A) were prepared according to the following table:

TABLE 5

| | H (C) | I (B) | L (A) |
|---|---|---|---|
| Water at 30–35° C. ml. | 800 | 800 | 800 |
| $NH_2OH.\frac{1}{2}H_2SO_4$ g. | 2.3 | — | 2.3 |
| pH-adjusting composition F ml. | — | 51.6 | — |
| Antioxidant composition E ml. | — | 8.6 | — |
| DTPA g. | 2.1 | — | 2.1 |
| NTA.3Na.$H_2O$ g. | 0.5 | — | 0.5 |
| $K_2CO_3$ g. | 32.7 | — | 32.7 |
| NaBr g. | 0.8 | — | — |
| KCl g. | 0.4 | — | — |
| Developer solution C, fresh, ml. | 66.2 | — | — |
| Developer solution B, storaged at 50° C. for 20 days, ml. | — | 80.0 | — |
| Developer solution A, storaged at 50° C. for 30 days, ml. | — | — | 68.8 |
| Starter solution G ml. | 14.0 | 14.0 | 14.0 |
| Water to make ml. | 1,000 | 1,000 | 1,000 |
| Specific gravity at 20° C. | 1.040 | 1.043 | 1.040 |
| pH at 20° C. | 10.06 | 10.04 | 10.00 |

Samples of 3M Color Negative ASA 100 and Kodak Color Negative ASA 100 films were exposed through a K 0.3 wedge at 5,500° K. and developed in the following processing lines (1, 2 and 3) according to the following table:

TABLE 6

| | 1 | 2 | 3 |
|---|---|---|---|
| Developer H | 3'15" | — | — |
| Developer I | — | 3'15" | — |
| Developer L | — | — | 3'15" |
| 3M CNP-4 bleach | 4'20" | 4'20" | 4'20" |
| washing | 3'15" | 3'15" | 3'15" |
| 3M CNP-4 fixer | 4'30" | 4'30" | 4'30" |
| washing | 3'15" | 3'15" | 3'15" |
| 3M CNP-4 stabilizer | 1'15" | 1'15" | 1'15" |
| Drying | 3'-4' | 3'-4' | 3'-4' |

The processed samples were read in an automatic densitometer: no substantial difference in Dmax, contrast, speed and fog values were noted in the magenta, yellow and cyan layers between developers prepared with fresh and storaged concentrated solutions. When a ready for use color developer prepared with concentrated solution D storaged at 50° C. for few days was used to develop color films, a strong fog increase was noticed.

EXAMPLE 4

A developer concentrated kit (that is a developer composition packaged in two or more concentrated parts) containing separate bottles respectively containing the following concentrated solutions:

| pH-adjusting solution M (having pH at 20° C. equal to 11.25) | |
|---|---|
| 35% KOH | 8.1 ml. |
| $Na_2SO_3$ | 1.1 g. |
| $NTA.3Na.H_2O$ | 2.7 g. |
| DTPA | 12.5 g. |
| $K_2CO_3$ | 180.0 g. |
| $KHCO_3$ | 10.5 g. |
| NaBr | 4.5 g. |
| KCl | 21.5 g. |
| Water to make | 350.0 ml. |

| Antioxidant solution N (having pH at 20° C. equal to 3.00) | |
|---|---|
| $NH_2OH.\frac{1}{2}H_2SO_4$ | 14.2 g. |
| $H_2SO_42N$ to adjust pH at | 3.0 |
| Water to make | 50 ml. |

| Developer solution O (having pH at 20° C. equal to 6.50) | |
|---|---|
| $K_2S_2O_5$ | 20.0 g. |
| $CD_4.H_2SO_4.H_2O$ | 26.5 g. |
| KOH 35% | 20.0 ml. |
| Water to make | 350.0 ml. |

was prepared. The liquids were poured into 4 liters of water in the indicated order (M, N, O) followed by 70 ml. of concentrated starter developer P having the following composition:

| Starter solution P (having pH at 20° C. equal to 10.00) | |
|---|---|
| KOH 35% | 4 ml. |
| $NTA.3Na.H_2O$ | 5 g. |
| DPTA | 21.5 g. |
| $K_2CO_3$ | 195.5 g. |
| $NaHCO_3$ | 37.5 g. |
| KCl | 4.8 g. |
| KJ | 73.3 mg. |
| NaBr | 37.6 g. |

Water was added to make 5 liters of a complete developer. Three different storaged samples of developer Q were prepared: Developer $Q_1$ whose concentrated part O was stored at 50° C. for 30 days and Developer $Q_2$ prepared with fresh part O.

Samples of Kodak Color Negative ASA 100 films were exposed through a K 0.3 wedge at 5,500° K. and developed in the following processings (1 and 2) according to the following table:

TABLE 7

| | 1 | 2 |
|---|---|---|
| Developer $Q_1$ | 3'15" | — |
| Developer $Q_2$ | — | 3'15" |
| 3M CNP-4 bleach | 4'20" | 4'20" |
| washing | 3'15" | 3'15" |
| 3M CNP-4 fixer | 4'30" | 4'30" |
| washing | 3'15" | 3'15" |
| 3M CNP-4 stabilizer | 1'15" | 1'15" |
| drying | 3'-4' | 3'-4' |

The processed samples did not exhibit any substantial difference in contrast, speed and fog values in the magenta, yellow and cyan layers in comparison with the standard Kodak C-41 Process and Chemistry having the concentrated part containing the color developer at pH lower than 2 both fresh and storaged at 50° C. A different behavior as regards Dmax was noticed, according to the following table:

TABLE 8

| | Dmax | | |
|---|---|---|---|
| | Yellow | Magenta | Cyan |
| C 41 Developer Fresh | 2.75 | 2.25 | 1.80 |
| C 41 Developer stored at 50° C. for 1 month | 2.65 | 2.18 | 1.73 |
| $Q_1$ Developer | 2.80 | 2.25 | 1.80 |
| $Q_2$ Developer | 2.80 | 2.33 | 1.90 |

The results show that concentrated color developer solutions according to the present invention are stable in the various storage conditions.

Experiments have also been made with developer samples whose concentrated part O was stored at room temperature for six months in two plastic bottles respectively filled up to half and to the lip. No substantial difference in Dmax, contrast, speed and fog values were noticed in the magneta, yellow and cyan layers between developers including fresh or storaged (as per above) part O solutions.

I claim:

1. A photographic color developer composition packaged in two or more concentrated parts, such that on mixing with water the parts, form a ready-for-use silver halide color developer solution, one part thereof consisting of an aqueous concentrated solution containing an N-hydroxyalkyl-substituted p-phenylene diamine salt developing agent and a sulfite compound as antioxidant, characterized by the fact that said aqueous concentrated solution has a pH from 6 to 8.

2. A photographic color developer composition according to claim 1, in which the N-hydroxy-substituted p-phenylene diamine developing agent is a 4-amino-3-methyl-N-ethyl-(β-hydroxyethyl)-aniline.

3. A photographic color developer composition according to claim 1, in which the molar ratio of the sulfite compound to the N-hydroxyalkyl-substituted p-phenylene diamine salt developing agent is higher than 1.5:1.

4. A photographic color developer composition according to claim 1, in which said aqueous concentrated solution includes an ascorbic acid compound as additional antioxidant.

5. A photographic color developer composition according to claim 1, in which said aqueous concentrated solution contains 50 to 120 grams per liter of N-hydroxyalkyl-substituted p-phenylene diamine salt developing agent.

6. A photographic color developer composition according to claim 1 comprising a second concentrated part including an alkaline substance.

7. A photographic color developer composition according to claim 1 comprising a third concentrated part including a hydroxylamine compound.

8. An aqueous-concentrated solution comprising a N-hydroxyalkyl-substituted p-phenylene diamine salt developing agent and a sulfite compound, characterized in that said solution has a pH from 6 to 8.

9. An aqueous concentrated solution according to claim 8, in which the N-hydroxyalkyl-substituted p-phenylene diamine developing agent is a 4-amino-3-methyl-N-ethyl-N-(β-hydroxyethyl)-aniline.

10. An aqueous concentrated solution according to claim 8 in which the molar ratio of the sulfite compound to the N-hydroxyalkyl-substituted p-phenylene diamine salt developing agent is higher than 1.5:1.

11. An aqueous concentrated solution according to claim 8 as antioxidant additionally including an ascorbic acid compound.

12. An aqueous concentrated solution according to claim 8 containing 50 to 120 grams per liter of N-hydroxyalkyl-substituted p-phenylene diamine salt developing agent.

* * * * *